US012435579B2

(12) United States Patent
Abuelaish et al.

(10) Patent No.: US 12,435,579 B2
(45) Date of Patent: Oct. 7, 2025

(54) WIRELESS WEAR DETECTION FOR SEALING ELEMENTS

(71) Applicant: Schlumberger Technology Corporation, Sugar Land, TX (US)

(72) Inventors: Ahmed Abuelaish, Sugar Land, TX (US); Thomas Leonard, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 23 days.

(21) Appl. No.: 18/685,540

(22) PCT Filed: Aug. 18, 2022

(86) PCT No.: PCT/US2022/040727

§ 371 (c)(1),
(2) Date: Feb. 22, 2024

(87) PCT Pub. No.: WO2023/027934

PCT Pub. Date: Mar. 2, 2023

(65) Prior Publication Data

US 2024/0352804 A1 Oct. 24, 2024

Related U.S. Application Data

(60) Provisional application No. 63/236,352, filed on Aug. 24, 2021.

(51) Int. Cl.

| | |
|---|---|
| ***E21B 12/02*** | (2006.01) |
| ***E21B 33/08*** | (2006.01) |
| ***E21B 47/13*** | (2012.01) |

(52) U.S. Cl.

CPC ..... *E21B 12/02* (2013.01); *E21B 33/085* (2013.01); *E21B 47/13* (2020.05)

(58) Field of Classification Search

CPC ..... E21B 12/02; E21B 47/13; E21B 33/085

(Continued)

(56) References Cited

U.S. PATENT DOCUMENTS

| | | | | |
|---|---|---|---|---|
| 6,016,880 | A | 1/2000 | Hall | |
| 10,358,914 | B2 * | 7/2019 | Roberson | E21B 47/01 |

(Continued)

FOREIGN PATENT DOCUMENTS

| | | | |
|---|---|---|---|
| AU | 2007243411 | A1 | 11/2007 |
| CA | 2649829 | C | 11/2016 |

(Continued)

*Primary Examiner* — Tara Schimpf
*Assistant Examiner* — Patrick F Lambe
(74) *Attorney, Agent, or Firm* — Jeffrey D. Frantz

(57) ABSTRACT

A drilling system is provided that includes a wellbore device. The wellbore device includes a housing including a bore and a seal element composed of an elastomeric material. positioned within the housing, and configured to seal the bore. The wellbore device includes a bearing assembly supported within the housing and configured to enable the seal element to rotate relative to the housing. The drilling system includes a wireless seal wear monitoring system that includes an RFID tag embedded within the seal element and an RFID transceiver and an RFID antenna disposed within a recess of the housing at an axial location adjacent the RFID tag. The RFID transceiver and RFID antenna are configured to communicate with the RFID tag and a control system. The control system is configured to determine a presence of wear in the seal element based on information provided by the RFID tag.

19 Claims, 8 Drawing Sheets

(58) Field of Classification Search
USPC ..... 175/39
See application file for complete search history.

(56) References Cited

U.S. PATENT DOCUMENTS

| | | | | |
|---|---|---|---|---|
| 10,570,689 | B2 * | 2/2020 | Jaffrey | G01L 1/242 |
| 11,149,507 | B2 | 10/2021 | Tran | |
| 11,187,056 | B1 | 11/2021 | Tenorio | |
| 2010/0218937 | A1 | 9/2010 | Edvardsen | |
| 2013/0118749 | A1 | 5/2013 | Hannegan | |
| 2015/0337599 | A1 * | 11/2015 | Bullock | E21B 47/007 702/9 |
| 2016/0075189 | A1 | 3/2016 | Engel | |
| 2016/0266021 | A1 | 9/2016 | Moon | |
| 2017/0009550 | A1 | 1/2017 | Leuchtenberg | |
| 2018/0245444 | A1 | 8/2018 | Hardt | |
| 2020/0157907 | A1 | 5/2020 | Jaffrey | |
| 2020/0157910 | A1 | 5/2020 | Sehsah | |
| 2020/0400420 | A1 | 12/2020 | Cummer | |

FOREIGN PATENT DOCUMENTS

| | | | |
|---|---|---|---|
| WO | 03042485 | A2 | 5/2003 |
| WO | 2014165314 | A2 | 10/2014 |
| WO | 2015006836 | A1 | 1/2015 |
| WO | 2023147409 | A1 | 8/2023 |

* cited by examiner

WIRELESS WEAR DETECTION FOR SEALING ELEMENTS

CROSS-REFERENCE TO RELATED APPLICATION

This application claims priority to International Application No. PCT/US2022/040727, entitled "WIRELESS WEAR DETECTION FOR SEALING ELEMENTS," filed Aug. 18, 2022, which claims priority to and the benefit of U.S. Provisional Patent Application No. 63/236,352, entitled "WIRELESS WEAR DETECTION FOR SEALING ELEMENTS," filed Aug. 24, 2021, the disclosures of which are hereby incorporated herein by reference in their entirety.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be noted that these statements are to be read in this light, and not as admissions of prior art.

Wellbores may be drilled into a surface location or sea bed for a variety of exploratory or extraction purposes. For example, a wellbore may be drilled to access fluids, such as liquid and gaseous hydrocarbons, stored in subterranean formations and to extract the fluids from the formations. A variety of drilling methods and tools may be utilized depending partly on the characteristics of the formation through which the wellbore is drilled.

In terms of wellbore process safety, sealing elements used in wellbore devices play a fundamental role in completing the primary well barrier envelope. The sealing elements are, by design, the weakest link in the well barrier envelope, acting as a sacrificial element that can be easily replaced at the end of its lifespan or at planned intervals for preventative measures. The elastomers making up the sealing elements are the single point of contact with the drill pipe creating a pressure tight seal, therefore they become exposed to any mechanical abrasion caused by any drill pipe movement through the elements. The operating conditions (drill pipe type and condition, rig alignment, annular pressure, and rate of movement), elastomer material, and thickness of material, play an integral role in the lifetime of the sealing element. A sudden failure of the sealing element may contribute to a well control event or another such operational setback.

The standard method for identifying worn seal elements is through observing signs of a compromised wellbore envelope such as instances of loss or reduction in pressure or leaking of wellbore fluids past the seal. Quantifying the degree of wear is only possible once the seal elements are removed from service. To grade the material loss, a measurement of the inner diameter of the sealing element is compared to its original dimension.

Without a real-time system for monitoring wear, assessing the condition of an installed seal element is relegated to assumptive methods based on comparison of current conditions to historical trends. These methods are subjective and often result in unexpected failures, especially when factors such as drill pipe condition and the presence of abnormal damage, wear, and tear are unaccounted for.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

Figure 1:
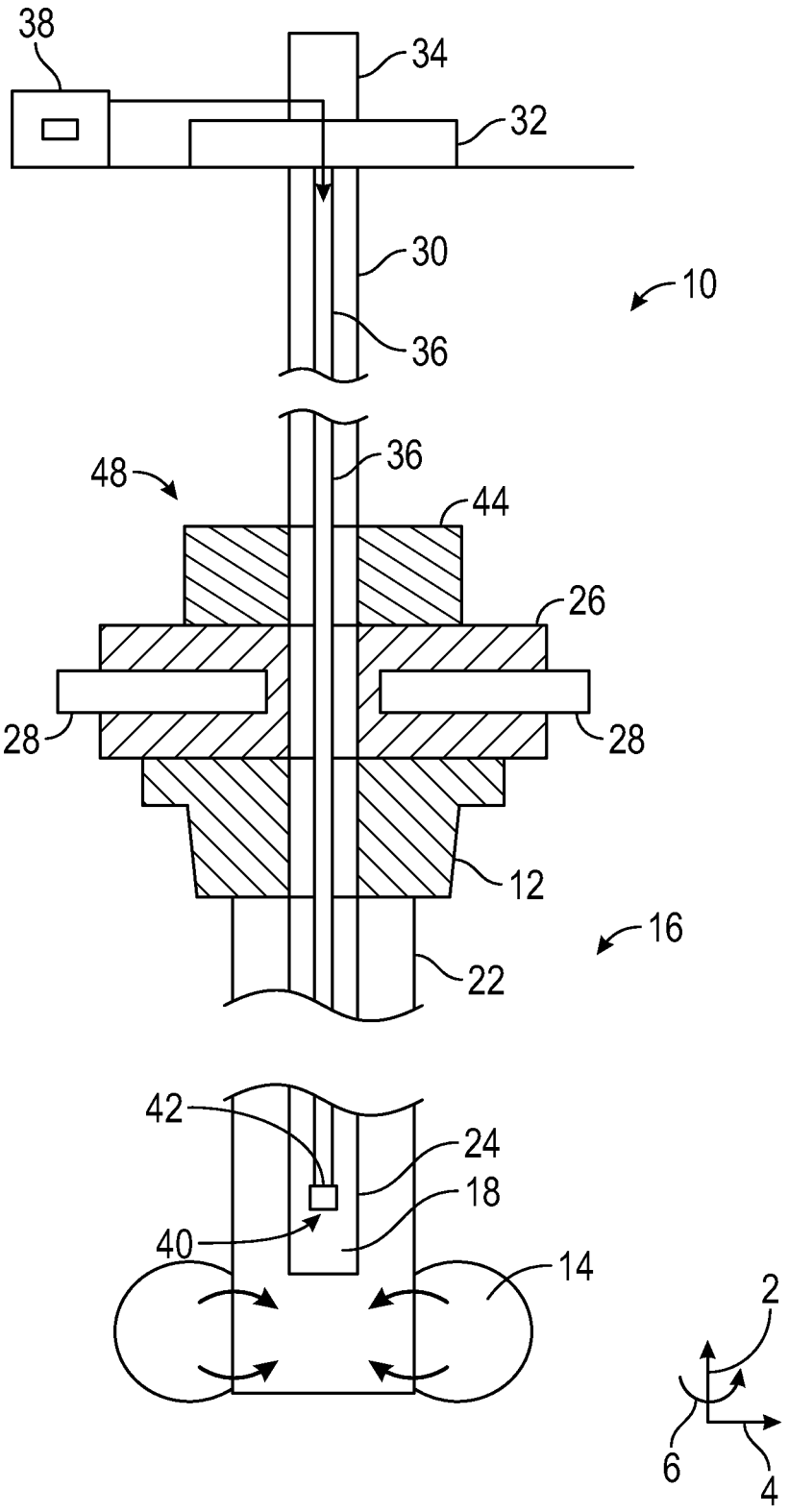
FIG. 1 is a schematic diagram of a drilling system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," "said," and the like, are intended to mean that there are one or more of the elements. The terms "comprising," "including," "having," and the like are intended to be inclusive and mean that there may be additional elements other than the listed elements. The use of "top," "bottom," "above," "below," and variations of these terms is made for convenience, but does not require any particular orientation of the components relative to some fixed reference, such as the direction of gravity. The term "fluid" encompasses liquids, gases, vapors, and combinations thereof. Numerical terms, such as "first," "second," and "third" are used to distinguish components to facilitate discussion, and it should be noted that the numerical terms may be used differently or assigned to different elements in the claims.

As set forth above, a drilling system may include a drilling fluid system that is configured to circulate drilling fluid into and out of a wellbore to facilitate drilling the wellbore. For example, the drilling fluid system may provide a flow of the drilling fluid through a drill string as the drill string rotates a drill bit that is positioned at a distal end portion of the drill string. The drilling fluid may exit through one or more openings at the distal end portion of the drill string and may return toward a platform of the drilling system via an annular space between the drill string and a casing that lines the wellbore.

In some cases, the drilling system may use managed pressure drilling ("MPD"). MPD regulates a pressure and a flow of the drilling fluid within the drill string so that the flow of the drilling fluid does not over pressurize a well (e.g., fracture the well) and/or blocks the well from collapsing under its own weight. The ability to manage the pressure and the flow of the drilling fluid enables use of the drilling system to drill into formations with narrow or uncertain pressure margins.

The present embodiments generally relate to methods and systems for actively monitoring the wear on sealing elements in wellbore devices (e.g., a rotating control device (RCD) system) and processing logged data to predict potential (and thereby preclude) complete breakdown of the sealing elements. Monitoring of the sealing elements may occur by using an array of sensors (e.g., passive radio frequency-identification (RFID) tags) embedded in the elastomer of the sealing element at incremental depths, offset from the internal diameter of the material. These tags may be installed within areas of the seal with the greatest wear exposure or distributed to provide a higher resolution of wear detection. As the elastomer's internal diameter is worn away, the RFID tag(s) embedded at that point become exposed to the source of wear and are subsequently destroyed. When the monitoring system queries the RFID tags, it interprets the responses to determine which tags are intact and which have been damaged. Based on the response from remaining RFID tags and the time at which the signal was lost from the damaged tags, the monitoring system can determine the current thickness of material, determine the rate of material loss/wear, and correlate such data to possible conditions contributing to these factors.

The RFID tags can be distributed radially around the circumference of the sealing elements such that they detect wear in the X, Y, and Z axes of the sealing element. Each tag is pre-programmed with data that adheres to a uniform code that includes a unique identifier that the system uses to determine its given position and depth within the elastomer. Using this information, and combining the responses from multiple tags, the system can deduce eccentric wear or more serious localized damage such as a tear in the material. Although the monitoring system is described utilizing RFID tags, other types of sensors (e.g., electrodes printed on or in a substrate using carbon nanotube ink and subjected to a voltage to create an electric field that may be monitored for thickness changes in the seal material) may be utilized in monitoring seal wear.

FIG. 1 is a schematic diagram that illustrates an embodiment of a drilling system 10 that is configured to carry out drilling operations. The drilling system 10 may be a subsea system, although the disclosed embodiments may be used in a land-based (e.g., surface) system. The drilling system 10 may use MPD techniques. As illustrated, the drilling system 10 includes a wellhead assembly 12 coupled to a mineral deposit 14 via a well 16 having a wellbore 18.

The wellhead assembly 12 may include or be coupled to multiple components that control and regulate activities and conditions associated with the well 16. For example, the wellhead assembly 12 generally includes or is coupled to pipes, bodies, valves, and seals that enable drilling of the well 16, route produced minerals from the mineral deposit 14, provide for regulating pressure in the well 16, and provide for the injection of drilling fluids into the wellbore 18. A conductor 22 may provide structure for the wellbore 18 and may block collapse of the sides of the well 16 into the wellbore 18. A casing 24 may be disposed within the conductor 22. The casing 24 may provide structure for the wellbore 18 and may facilitate control of fluid and pressure during drilling of the well 16. The wellhead assembly 12 may include a tubing spool, a casing spool, and a hanger (e.g., a tubing hanger or a casing hanger) to enable installation of the casing 24. As shown, the wellhead assembly 12 may include or may be coupled to a blowout preventer (BOP) assembly 26, which may include one or more ram BOPs. For example, the BOP assembly 26 shown in FIG. 1 includes a ram BOP having moveable rams 28 configured to seal the wellbore 18.

A drilling riser 30 may extend between the BOP assembly 26 and a platform or floating vessel 32. The platform 32 may include various components that facilitate operation of the drilling system 10, such as pumps, tanks, and power equipment. The platform 32 may also include a derrick 34 that supports a tubular 36 (e.g., drill string), which may extend through the drilling riser 30. A drilling fluid system 38 may direct the drilling fluid into the tubular 36, and the drilling fluid may exit through one or more openings at a distal end portion 40 of the tubular 36 and may return (along with cuttings and/or other substances from the well 16) toward the platform 32 via an annular space (e.g., between the tubular 36 and the casing 24 that lines the wellbore 18; between the tubular 36 and the drilling riser 30). A drill bit 42 may be positioned at the distal end portion 40 of the tubular 36. The tubular 36 may rotate within the drilling riser 30 to rotate the drill bit 42, thereby enabling the drill bit 42 to drill and form the well 16.

As shown, the drilling system 10 may include a rotating control device (RCD) system 44 that is configured to form a seal across and/or to block fluid flow through the annular space that surrounds the tubular 36. Alternatively, the RCD system 44 can divert fluid flow to various surface equipment (e.g., chokes) for controlling pressure. For example, the RCD system 44 may be configured to block the drilling fluid, cuttings, and/or other substances from the well 16 from passing across a seal element of the RCD system 44 toward the platform 32. The RCD system 44 may be positioned at any suitable location within the drilling system 10, such as any suitable location between the wellbore 18 and the platform 32. For example, as shown, the RCD system 44 may positioned between the BOP assembly 26 and the platform 32.

In operation, the tubular 36 may be rotated and/or moved along an axial axis 2 to enable the drill bit 42 to drill the well 16. As discussed in more detail below, methods and systems may be provided to actively monitor wear on sealing elements in wellbore devices. For example, sealing elements of the RCD system 44 may be actively monitored for wear. Although the monitoring system is discussed with regard to monitoring wear on the sealing elements of the RCD system 44, the monitoring system may be utilized for any wellbore device that includes sealing elements. The drilling system 10 and its components may be described with reference to the axial axis 2 (or axial direction), a radial axis 4 (or radial direction), and a circumferential axis 6 (or direction) to facilitate discussion.

Figure 2:
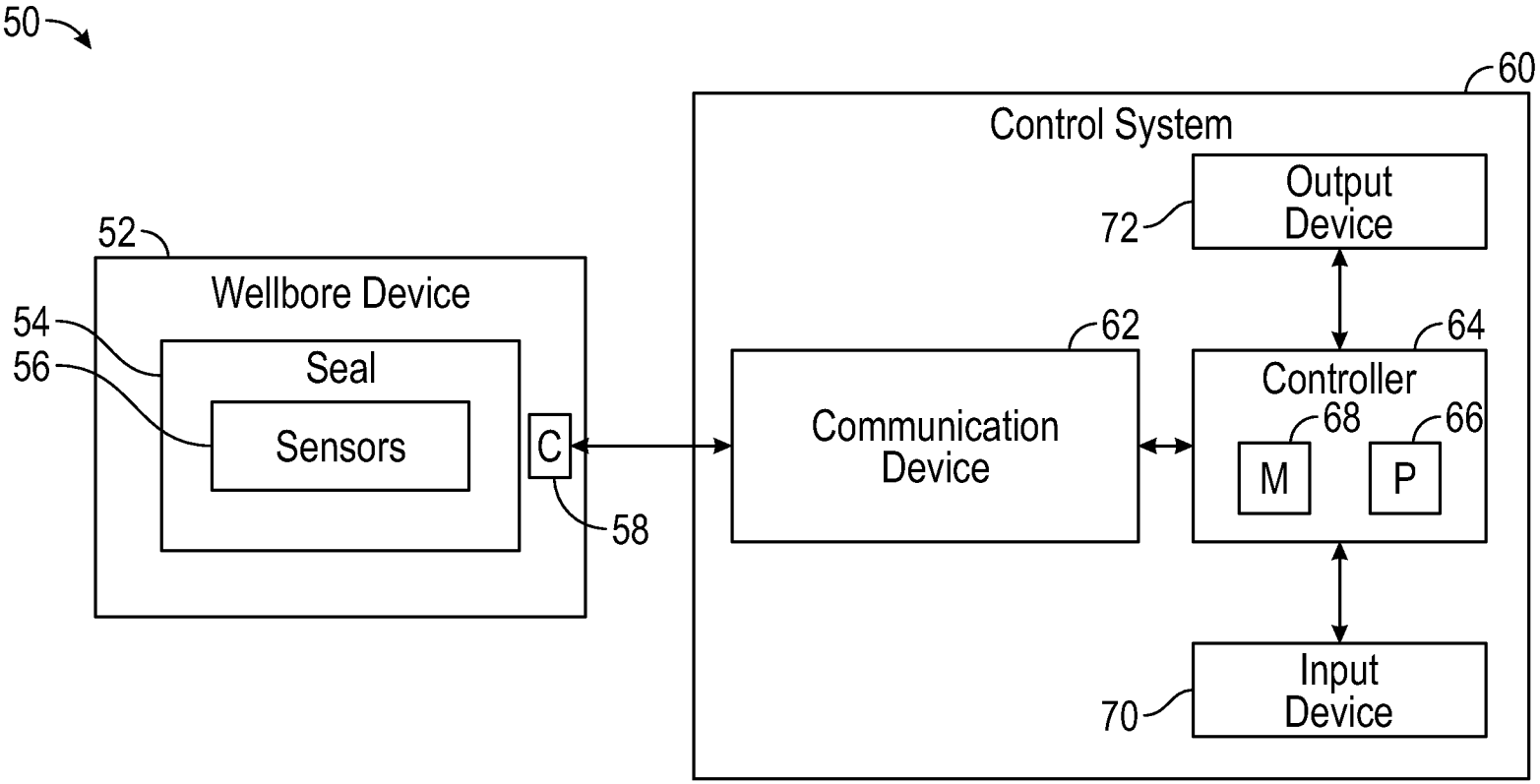
FIG. 2 is a schematic diagram of a monitoring system (e.g., seal wear monitoring system), in accordance with an embodiment of the present disclosure.

FIG. 2 is a schematic diagram of a monitoring system 50 (e.g., seal wear monitoring system) to be utilized with a wellbore device 52 (e.g., RCD system 44). The wellbore device 52 includes one or more seals or sealing elements 54. The monitoring system 50 includes one or more sensors 56 (e.g., RFID tags) disposed on and/or within each seal 54. The monitoring system 50 also includes one or more communication devices 58 (transceivers/antennas) disposed on and/or within a component of the wellbore device 52. In certain embodiments, the seal(s) with the sensors 56 may be disposed on a rotating component of the wellbore device and the communication devices 58 may be disposed on and/or within a stationary component (e.g., housing) of the wellbore device 52. The communication devices 58 wirelessly communicate with the sensors 56. The communication devices query and collect data from the sensors 56.

The monitoring system 50 includes a control system 60 (e.g., RCD control system) for the wellbore device 52. The control system 60 includes a communication device 62 (e.g., wireless communication device) that receives the collected sensor data from the communication devices 58 related to the wear of the seals 54 and provides it to a controller 64. The controller 64 may monitor the data from the sensors 56 to determine if any wear is occurring with regard to the seals 54 and predicting any potential complete breakdowns of the seals 54 based on the data. The controller 64 may also provide a signal related to an alarm or alert of a predicted complete breakdown of a seal.

The controller 64 includes a processor 66 and a memory device 68. It should be appreciated that the controller 64 may be a dedicated controller for wellbore device 52 and/or the controller 64 may be part of or include a distributed controller with one or more electronic controllers in communication with one another to carry out the various techniques disclosed herein. The processor 66 may also include one or more processors configured to execute software, such as software for processing the data collected from the sensors 56 to monitor and determine any seal wear within the seals 54. The memory device 68 disclosed herein may include one or more memory devices (e.g., a volatile memory, such as random access memory [RAM], and/or a nonvolatile memory, such as read-only memory [ROM]) that may store a variety of information and may be used for various purposes. For example, the memory device 68 may store processor-executable instructions (e.g., firmware or software) for the processor 66 to execute, such as instructions for processing the data collected from the sensors 56 to monitor and determine any seal wear within the seals 54. It should be appreciated that the communication device 62 is capable of communicating data or other information (e.g., seal wear data) from the controller 64 to various other devices (e.g., a remote computing system or display system at the platform).

The control system 60 may also include an input device 70 (e.g., touchscreen, keyboard, etc.) coupled to the controller 64. The control system 60 may also include an output device 72 (e.g., display) for displaying the seal wear data or information derived therefrom (e.g., wear patterns, sensors not reporting data, alerts or alarms related to a predicted complete breakdown of one or more seals 54, etc.).

Figure 3:
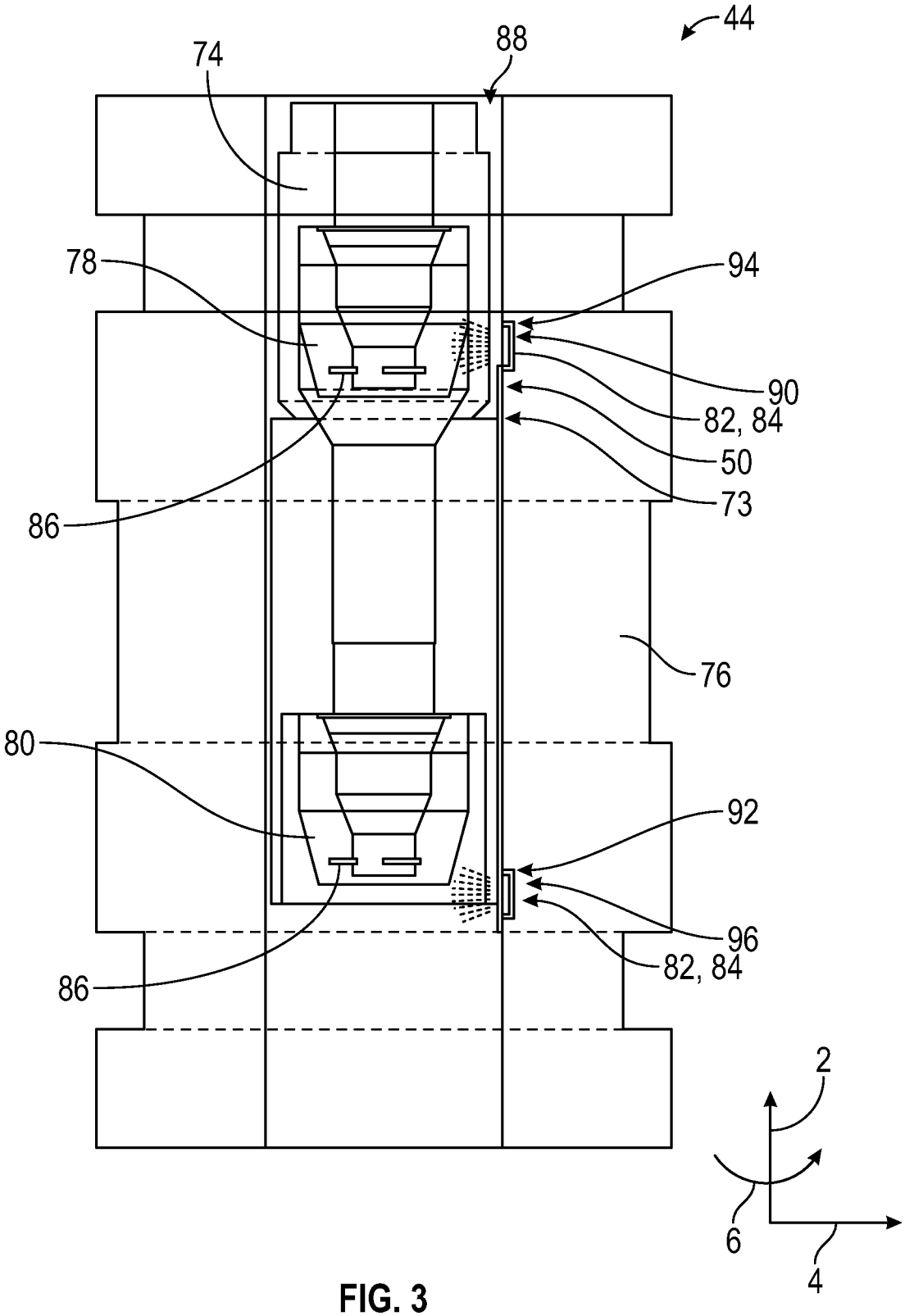
FIG. 3 is a schematic diagram of a portion of a seal wear monitoring system (utilizing a radio frequency identification (RFID) system) for a rotating control device (RCD) system, in accordance with an embodiment of the present disclosure.

FIG. 3 is a schematic diagram of a portion of the seal wear monitoring system 50 (utilizing a radio frequency-identification (RFID) system 73) for a rotating control device RCD system 44. The RCD system 44 is shown without a pipe disposed through it. The RCD system 44 includes a bearing assembly 74 disposed within a housing 76. The bearing assembly 74 includes an upper seal element 78 and a lower seal element 80. The RFID system consists of integrated RFID transceivers 82 and antennas 84 within the housing 76. The seal elements 78, 80 of the bearing assembly include, within the cast elastomers, an array of passive RFID transponder tags 86. Communication between the seals' RFID transponder tags 86 and RFID transceiver 82 is accomplished by way of UHF radio wave propagation, with the requisite beam-steered planar antennas 84 being installed within a bore 88 of the housing 76 at points optimal for this transmission.

RFID ultra-high frequency (UHF) (860-960 MHz) transceivers (or readers) 82 are installed inside existing, sealed pockets 90, 92 within the housing 76 at a first axial location 94 and a second axial location 96. Each pocket 90, 92 may include at least one transceiver 82. In certain embodiments, multiple pockets 90 including transceivers 82 may be located circumferentially 6 spaced apart about the axial axis 2 at the axial location 94. In certain embodiments, multiple pockets 92 including transceivers 82 may be located circumferentially 6 spaced apart about the axial axis 2 at the axial location 96. In certain embodiments, the pockets 90, 92 may each extend 360 degrees circumferentially 6 about the axial axis at their respective axial locations 94, 96 and each include multiple transceivers 82. The pockets 90, 92 provide a protected mounting point for the radio equipment and is conveniently located close to a source for power and connection to the housing's process field bus field device network. To ensure for optimal signal strength and quality, at least one reader 82 is installed inside the upper pocket 90, and at least one other reader 82 is installed inside the lower pocket 92 of the housing 76, each with its own antenna 84.

As noted above, planar, beam-forming antennas 84 (RFID antennas) are installed within recesses (e.g., pockets 90, 92) machined into the inside diameter of the housing 76, and sealed with an RF-transparent thermoset polymer. When the bearing assembly 74 is installed in the housing 76, the RFID tags 86 embedded in the seal elements 78,80 are situated at a functional distance from the antennas 84. The seal elements 78, 80 within the bearing assembly 74 rotate with the drill pipe (not shown), therefore, antennas 84 only need be integrated to one side of the housing 76. As the seal elements 78, 80 rotate inside the housing 76, the RFID transponders tags 86 embedded within will each coincide with the point of strongest signal emitting from the antenna 84. In certain embodiments, the location and number of antennas 84 may be similar to those of the transceivers 82 above.

Due to the thermal process used in the manufacturing of the seal element 78, 80, it is imperative that the RFID tag 86 selected for use be of a high temperature variant. Additionally, under the conditions in which these tags 86 will operate, the UHF radio frequency wavelength offers the best combination of package size, antenna size, propagation capability over a short distance (>1 meter), and transmission through dielectric or near-dielectric fluids such as oil-based drilling fluid. RFID transponder tags 86 are commonly available as active, passive, and semi-passive. In order to reduce any potential integrity loss of the seal element elastomer, a small, durable integrated circuit chip and antenna package is needed. Passive RFID tags 86 best fit this requirement. They are among the smallest options available, the most durable, and, since there is no internal power requirement, they have a shelf life that greatly exceeds that of the seal element 78, 80. A side benefit of the passive RFID tag 86 is their low cost and bulk availability. Each RFID tag 86 contains a writeable block of memory which may be wirelessly queried by the transceiver 82. The amount of memory available on the chip is determined by its manufacturer. A 512-bit user memory block may be sufficient to contain all data required in this system.

Figure 5:
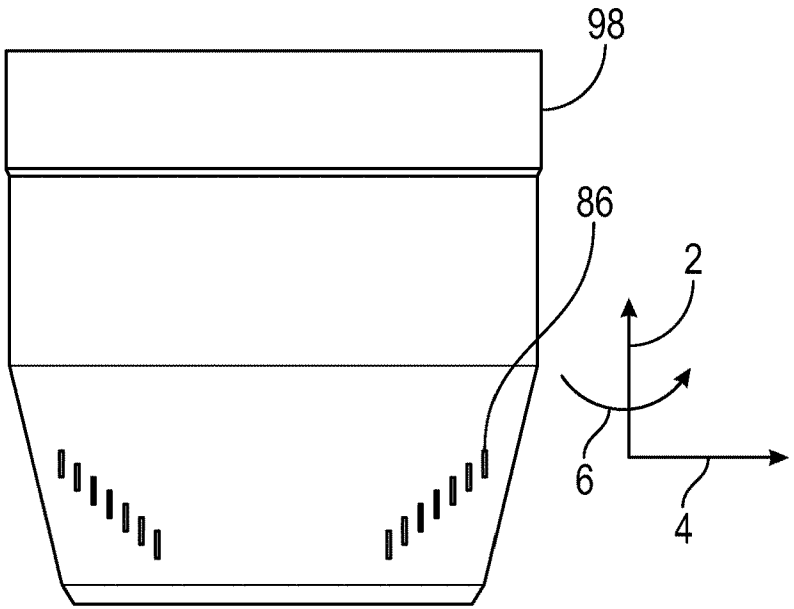
FIG. 5 is a schematic diagram of the distribution of RFID tags integrated within a seal element (e.g., evenly spaced with even vertical distribution) as viewed from the side, in accordance with an embodiment of the present disclosure.
Figure 4:
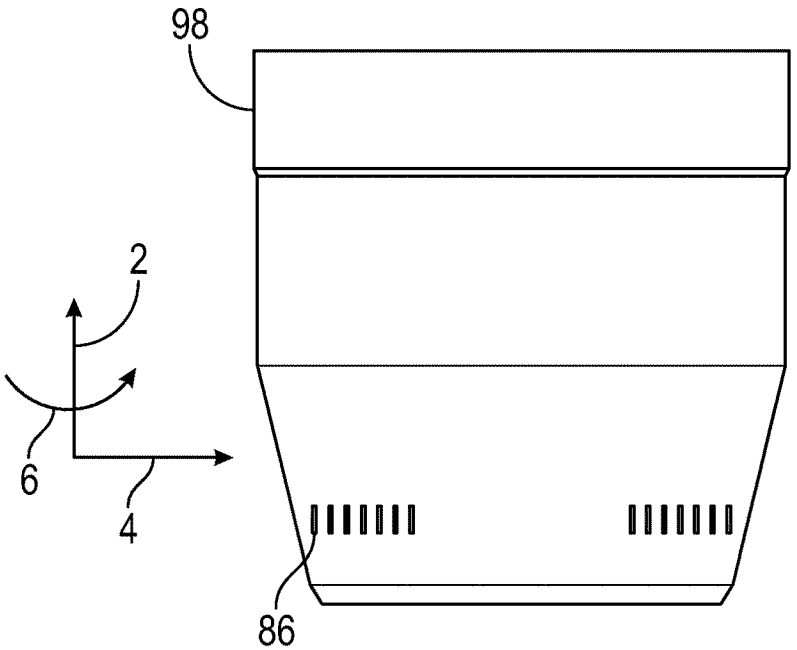
FIG. 4 is a schematic diagram of the distribution of RFID tags integrated within a seal element (e.g., evenly spaced with no vertical distribution) as viewed from the side, in accordance with an embodiment of the present disclosure.

FIGS. 4-7 illustrate the RFID tags 86 embedded in the elastomer of the sealing element 98 (e.g., seal elements 78 or 80) at incremental depths. The RFID tags 86 can be aligned in sequence behind one another or, preferably, distributed vertically (e.g., along axial axis 2) and/or radially 4 within the material to reduce stress concentrations that could compromise the structural integrity of the material. FIGS. 4 and 5 are schematic diagrams of the distribution of RFID tags 86 integrated within the elastomer of a seal element 98 (e.g., seal elements 78 or 80) as viewed from the side. In FIG. 4, the RFID tags 86 are evenly spaced in the radial direction 4 with no vertical distribution in the axial direction 2. In FIG. 5, the RFID tags 86 are evenly spaced in the radial direction 4 with vertical distribution in the axial direction 2. In certain embodiments, some of the RFID tags 86 may have no vertical distribution in the axial direction 2 while other RFID tags 86 have vertical distribution in the axial direction 2. Although the RFID tags in FIGS. 4 and 5 at least partially overlap in the radial direction 4, in certain embodiments, at least some of the RFID tags 86 may not overlap at all in the radial direction 4. The number of RFID tags 86 in each set may vary (e.g., 1, 2, 3, 4, 5, 6, or more).

Figure 7:
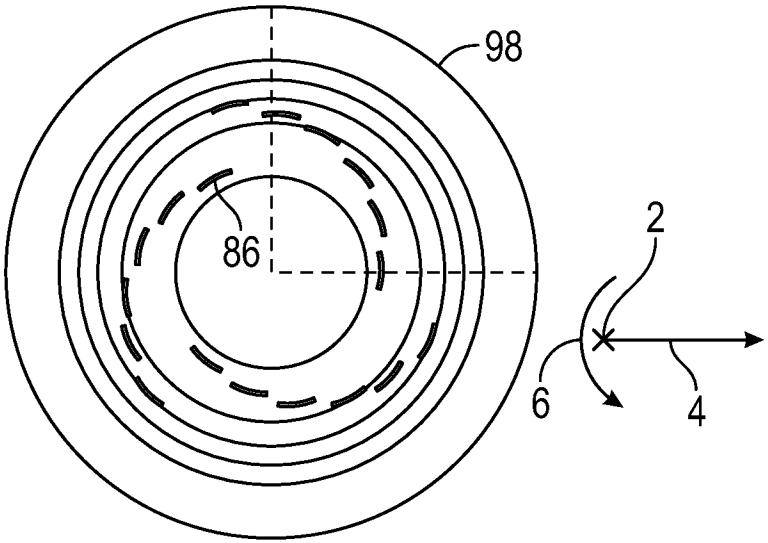
FIG. 7 is a schematic diagram of the distribution of RFID tags integrated within a seal element (e.g., evenly spaced with even radial distribution) as viewed from the top, in accordance with an embodiment of the present disclosure.
Figure 6:
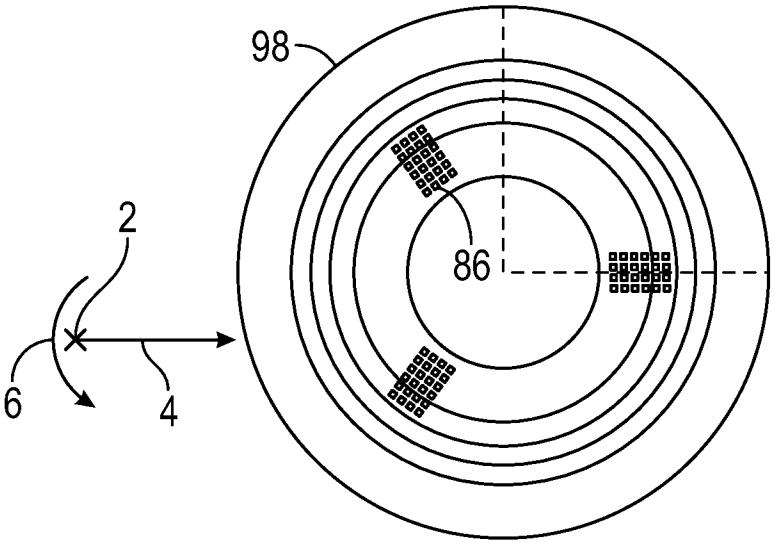
FIG. 6 is a schematic diagram of the distribution of RFID tags integrated within a seal element (e.g., evenly spaced with no radial distribution) as viewed from the top, in accordance with an embodiment of the present disclosure.

FIGS. 6 and 7 are schematic diagrams of the distribution of RFID tags 86 integrated within the elastomer of the seal element 98 (e.g., seal elements 78 or 80) as viewed from the top. In FIG. 6, a set of the RFID tags 86 are embedded every 120 degrees around the elastomer in the circumferential direction 6 about the axial axis 2 to enable measurements in the two axes regardless of orientation of the sealing elements 98. Each set of RFID tags 86 are radially 4 aligned in FIG. 6. As depicted, in FIG. 6, the RFID tags 86 are evenly spaced in the radial direction 4 with no radial distribution in the circumferential direction 6. In FIG. 7, each set of RFID tags 86 are circumferentially 6 distributed about the axial axis 2 at different radial locations in a non-overlapping manner in the radial direction 4. In certain embodiments, some of the RFID tags 86 of a set may at least partially overlap in the radial direction 4 once installed. As depicted, in FIG. 7, the RFID tags 86 are evenly spaced in the radial direction 4 with even radial distribution in the circumferential direction 6. The number of RFID tags 86 in each set may vary (e.g., 1, 2, 3, 4, 5, 6, or more).

Figure 10:
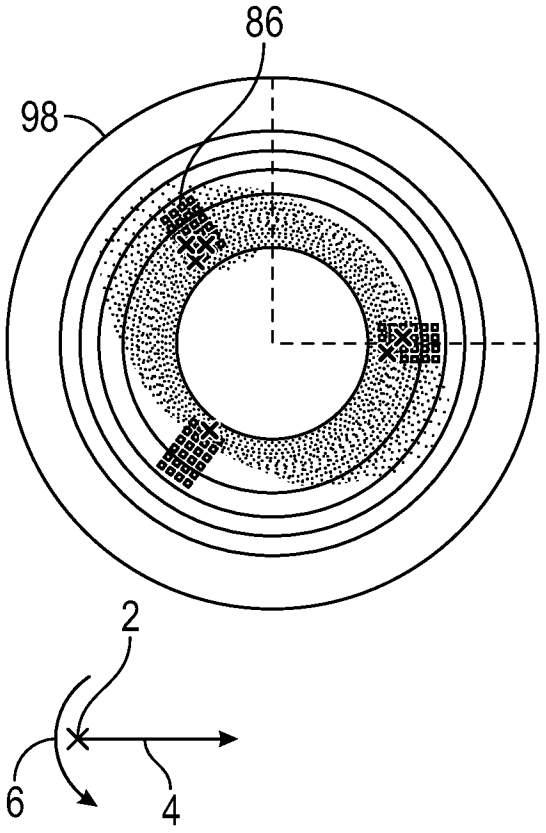
FIG. 10 is a schematic diagram of a wear pattern (e.g., eccentric wear pattern) detected by RFID tags integrated within a seal element as viewed from the top, in accordance with an embodiment of the present disclosure.
Figure 9:
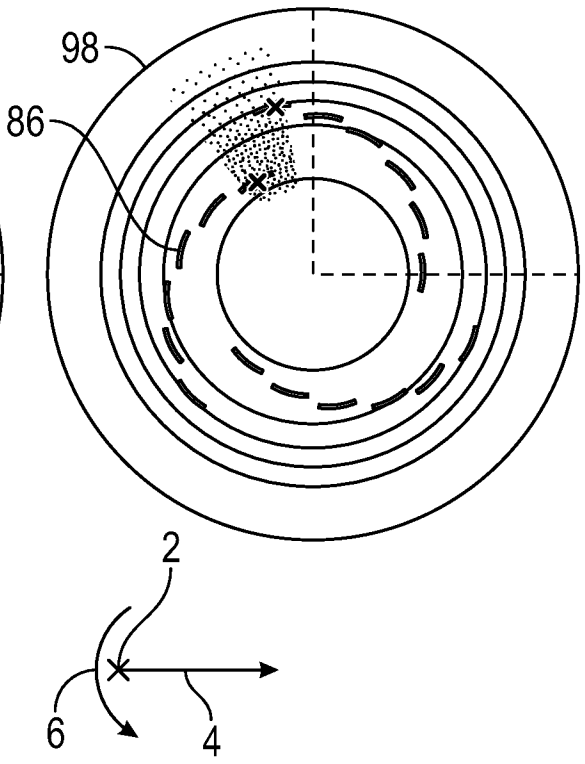
FIG. 9 is a schematic diagram of a wear pattern (e.g., localized wear/damage) detected by RFID tags integrated within a seal element as viewed from the top, in accordance with an embodiment of the present disclosure.
Figure 8:
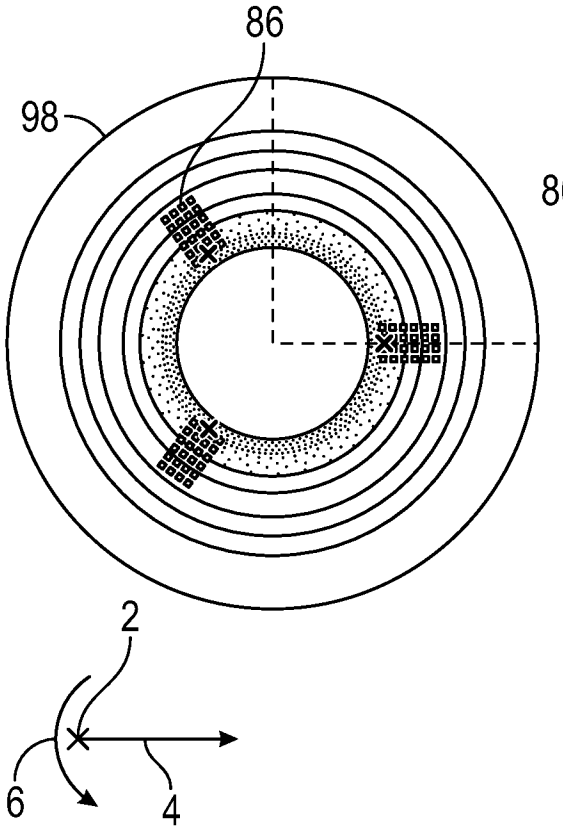
FIG. 8 is a schematic diagram of a wear pattern (e.g., normal wear pattern) detected by RFID tags integrated within a seal element as viewed from the top, in accordance with an embodiment of the present disclosure.

FIGS. 8-10 are schematic diagrams of different wear patterns detected by RFID tags 86 integrated within the seal element 98 (e.g., seal elements 78 or 80) as viewed from the top. An X indicates RFID tags 86 that no longer provide data due to being damaged by wear. FIG. 8 indicates normal wear (e.g., wear evenly distributed in both the radial direction 4 and the circumferential direction 6. FIG. 9 indicates localized wear or damage in a sector of the seal element 98. FIG. 10 indicates eccentric wear (e.g., uneven wear). A user interface may display these wear patterns and non-responsive RFID tags 86 (along with any alerts/confidence levels) in a manner similar to that shown in FIGS. 8-10.

The RFID UHF transceivers (e.g., transceivers or readers 82 in FIG. 3) periodically transmit a radio wave which acts upon the antenna (e.g., antenna 84 in FIG. 3) of each passive RFID tag (e.g., tag 86 in FIG. 3). The energy of this transmission is sufficient to power the tag's integrated chip which is encoded with data that may be modulated and reflected back to the RFID transceiver. All RFID tags within range of this transmission will simultaneously respond to this query, passing to the transceiver their unique data. During the seal element manufacturing process, the user data block of each transponder is programmed with a specific sequence of numbers that follows a uniform code structure. This data conveys specific information to wear detection software: seal element composition, unique serial number, date of manufacture, RFID array-type, and the RFID transponder's array-specific tag code.

Figure 11:
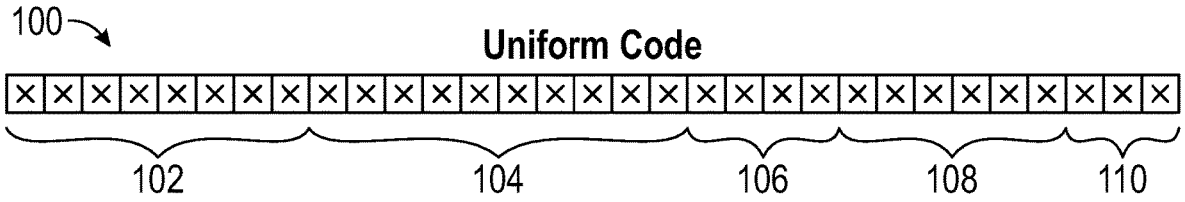
FIG. 11 is a schematic diagram of a uniform code, in accordance with an embodiment of the present disclosure.

FIG. 11 is a schematic diagram of a uniform code 100. The uniform code 100 includes a part number 102, a serial number 104, a manufacturing date 106, an array code 108, and a tag code 110. The part number 102 may identify a size drill pipe that the seal element is designed for and the composition of the elastomer. The serial number 104 may include a globally unique serial number assigned to a seal element at the time of manufacture. System software may utilize the serial number 104 to associate the tag code 110 to the correct seal element where more than one seal element is present in an RCD bearing assembly. The manufacturing date 106 provides the manufacturing date of the seal element. This is coded for the purpose of equipment inventory and performance analysis. The array code 108 may follow a pre-defined base-10 number assignment which identifies the array type. The system software contains a lookup table which associates the array code 108 to a unique permutation identifying the seal element's RFID total tag count, tag depth distribution, and array shape. The tag code 110 is an assembly-specific unique identifier assigned to each RFID transponder or tag in a given seal element. The tag code 110 informs the software of where this specific tag falls in the arrangement specified by the array code 108. The tag code 110 may be repeated in each separate seal element since each bears its own serial number and is part of the uniform code 100.

Figure 12:
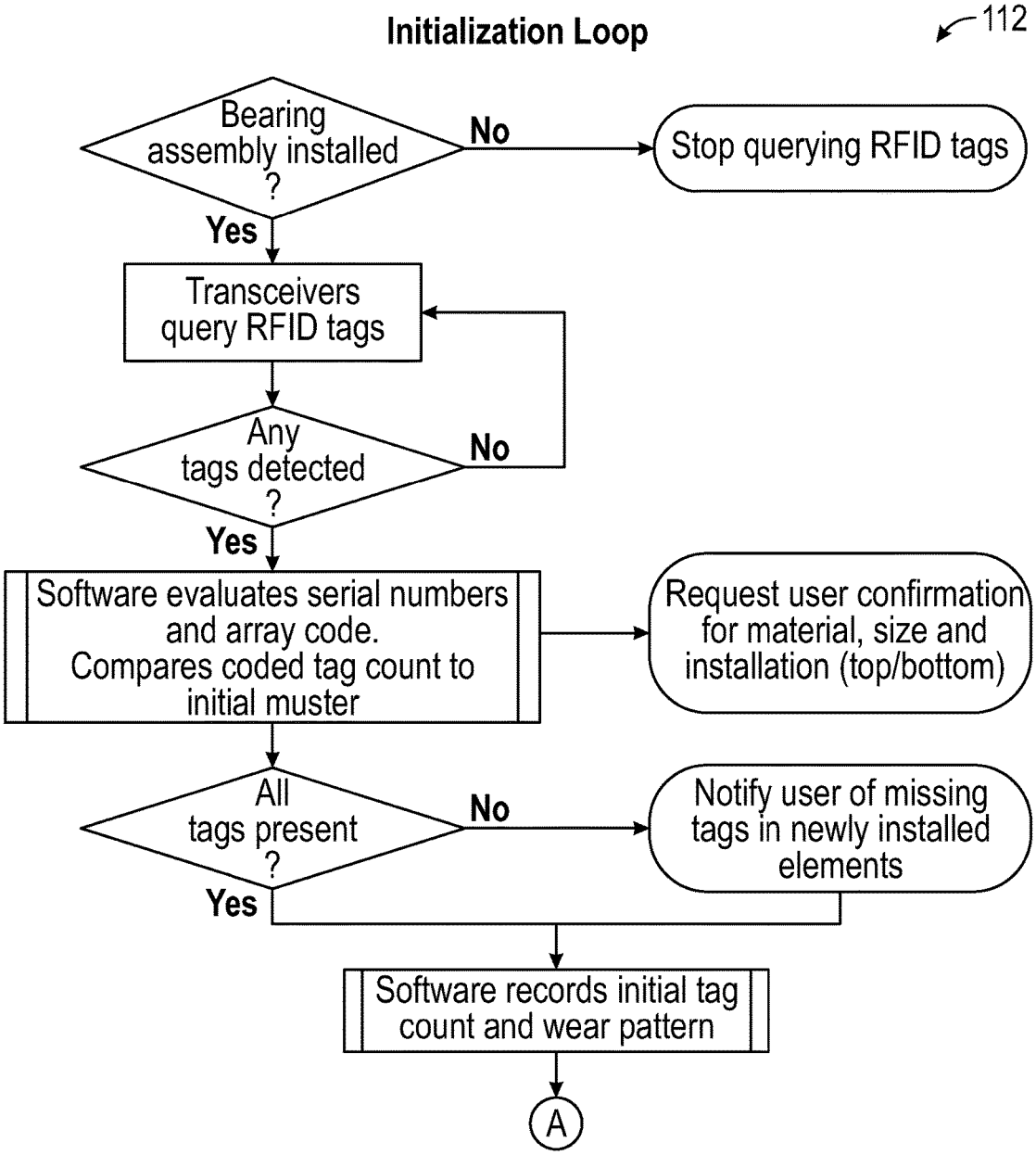
FIG. 12 is a flowchart of a method or process for initialization, in accordance with an embodiment of the present disclosure.

The uniform code 100 is fundamental in the wear detection process. It serves to structure RFID transponder data in a way that is meaningful to the wear detection software and ensures conformity across a range of seal element types. Wear detection software is integrated with the RCD control system (e.g., control system 60 in FIG. 2) and provides an interface for monitoring the status of the installed seal elements. When an RCD bearing assembly is first installed in the housing the RFID transceiver is activated and begins an initial muster of RFID tags present within the bearing's seal elements. The wear detection software uses the received data to initialize the configuration with the type of seal elements that are installed, how many RFID transponder tags are associated with the array type, and the array arrangement. From this data, the wear detection software can create a starting point for the wear detection process and align on-screen representations of each seal element as it wears from use. This initialization loop is outlined in the process or method 112 illustrated in FIG. 12. One or more steps of the method 112 may be performed by the components of the monitoring system 50 in FIG. 2.

Figure 13:
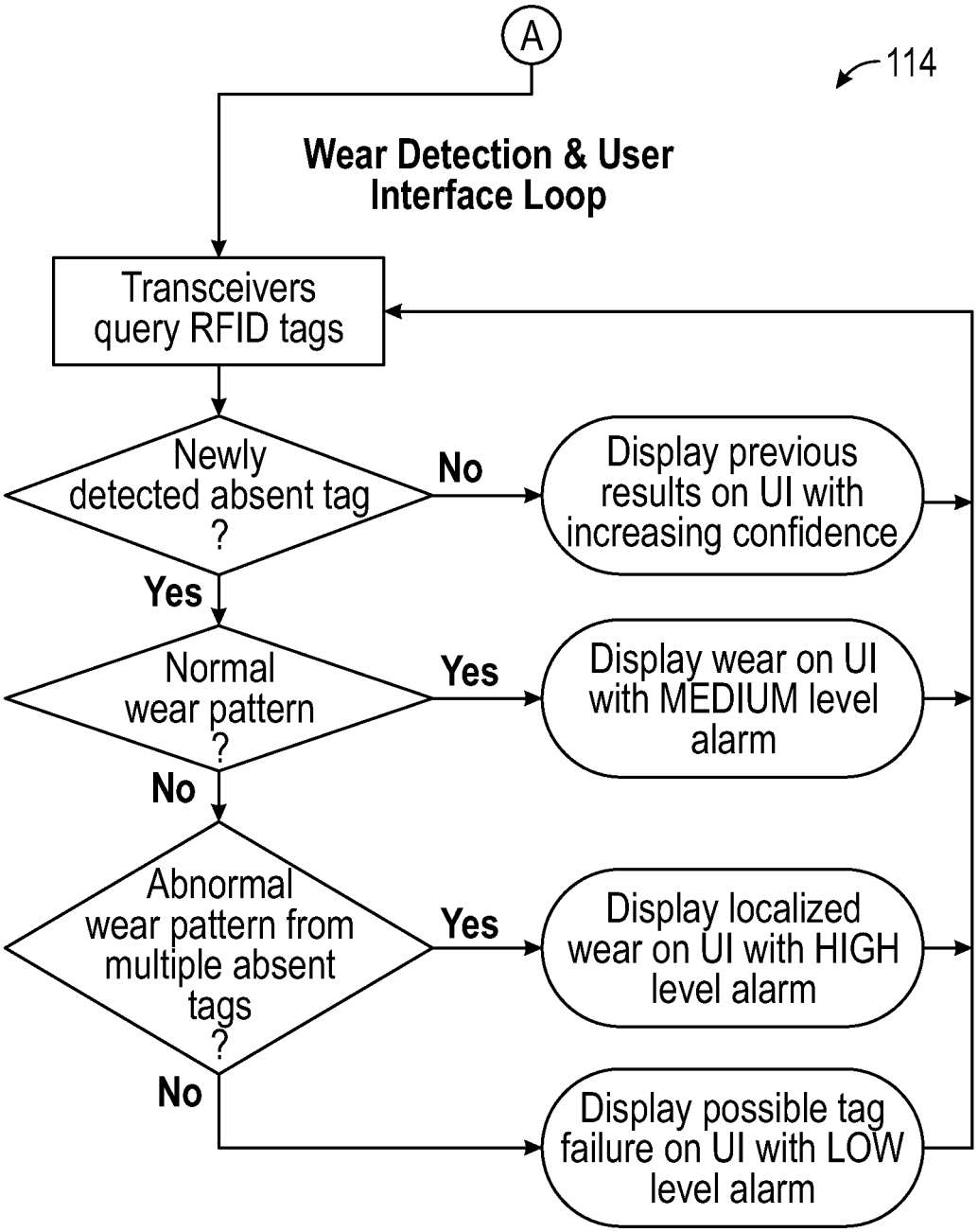
FIG. 13 is a flowchart of a method for process for wear detection, in accordance with an embodiment of the present disclosure.

Throughout the run time of the RCD bearing assembly, the RFID transceiver continues its queries for RFID tags at a set interval. The set interval may correspond to each revolution of the sealing element relative to the RFID transceiver. In other embodiments, the set interval (e.g., those experiencing a higher revolution per minute) may correspond to a set number of revolutions (e.g., 2, 3, or more). The software's logic process subjects changes in tag responses to a confidence factor which weights the order of transponder failure(s) according to the specific array type. When a transponder fails to respond, its unique tag code is compared to a pre-defined logical order of failure for that specific array type. If it fails in a logical order, the system marks the tag with a medium confidence value, updates the wear display, and flags it with a medium-level alarm. If a transponder fails out of order, it is marked as a low confidence failure and is flagged with a low-level alarm state. If another transponder fails out of order and, combined with the first out of order tag, matches an abnormal wear pattern the system returns with a high-level alarm. With each successive tag query, the confidence value may increase or decrease based upon the contrariety or consistency of a tag's response. This process guards against unconsidered interpretation of tag failures as an absolute indication of wear, which allows for some tolerance of process failure—at the expense of granularity—without compromising the overall appreciable indication of seal element wear. This wear detection and user interface loop is outlined in the process or method 114 illustrated in FIG. 13. One or more steps of the method 114 may be performed by the components of the monitoring system 50 in FIG. 2.

While the disclosure may be susceptible to various modifications and alternative forms, specific embodiments have been shown by way of example in the drawings and have been described in detail herein. However, it should be noted that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A drilling system, comprising:

a wellbore device, comprising:

a housing comprising a bore; and a seal element composed of an elastomeric material, positioned within the housing, and configured to seal the bore; and a bearing assembly supported within the housing and configured to enable the seal element to rotate relative to the housing; and a wireless seal wear monitoring system, comprising:

a plurality of radio frequency identification (RFID) tags embedded within the seal element, wherein the plurality of RFID tags is spaced at a plurality of radial positions relative to an axial axis of the seal element;

at least one RFID transceiver and RFID antenna disposed within a recess of the housing at an axial location adjacent at least one RFID tag of the plurality of RFID tags, wherein the RFID transceiver and RFID antenna are configured to communicate with the at least one RFID tag and a control system; and the control system is configured to determine a depth of wear in the seal element based on a lost communication with the at least one RFID tag caused by damage of the at least one RFID tag.

2. The drilling system of claim 1, wherein the wellbore device comprises a rotating control device.

3. The drilling system of claim 1, wherein each respective RFID tag of the plurality of RFID tags utilizes a uniform code that provides a unique identifier to the control system that identifies a given position and depth of the respective RFID tag within the seal element, and each lost communication with each respective RFID tag of the plurality of RFID tags indicates damage caused by wear at the given position and depth of the respective RFID tag.

4. The drilling system of claim 3, wherein the control system is configured to determine a type of wear pattern and a location of the wear in the seal element based on the information provided by the plurality of RFID tags and any lost communications with one or more RFID tags of the plurality of RFID tags.

5. The drilling system of claim 4, wherein the control system is configured to determine the type of wear pattern as one of a plurality of types of wear patterns, wherein the plurality of types of wear patterns comprises a normal wear pattern, a localized wear pattern, and an eccentric wear pattern.

6. The drilling system of claim 3, wherein the uniform code comprises a part number, a serial number, a manufacturing date, an array code, and a tag code.

7. The drilling system of claim 3, wherein the control system is configured to display the type of wear pattern, an alarm level associated with the wear pattern, and an indication of any non-responsive RFID tags on a user interface.

8. The drilling system of claim 1, wherein at least one RFID tag of the plurality of RFID tags is a passive RFID tag.

9. The drilling system of claim 1, wherein the plurality of RFID tags is evenly spaced at the plurality of radial positions relative to the axial axis of the seal element.

10. The drilling system of claim 9, wherein the plurality of RFID tags is disposed at a plurality of axial positions relative to the axial axis of the seal element.

11. The drilling system of claim 9, wherein the plurality of RFID tags is disposed at a plurality of circumferential positions in a circumferential direction about the axial axis of the seal element.

12. The drilling system of claim 11, wherein the plurality of RFID tags is embedded every 120 degrees around the seal element in the circumferential direction about the axial axis of the seal element.

13. The drilling system of claim 1, wherein the control system stores a position and a depth for each RFID tag of the plurality of RFID tags, and any lost communication with each RFID tag of the plurality of RFID tags indicates wear at the position and depth of the respective RFID tag.

14. A method, comprising:

installing a wellbore device, the wellbore device comprising:

a seal element;

a plurality of radio frequency identification (RFID) tags embedded within the seal element and arranged in an array; and a first communication device configured to wirelessly communicate with the plurality of RFID tags, wherein the first communication device comprises at least one RFID transceiver, wherein the plurality of RFID tags is spaced at a plurality of radial positions relative to an axial axis of the seal element, and wherein each RFID tag of the plurality of RFID tags is pre-programmed with data that adheres to a uniform code structure;

querying the plurality of RFID tags with the first communication device;

collecting initialization data from the plurality of RFID tags based on the uniform code structure;

transmitting the initialization data from the first communication device of the wellbore device to a second communication device of a control system associated with the wellbore device; and using the control system to create a starting point for detecting wear of the seal element based on the initialization data;

querying the plurality of RFID tags with the first communication device, wherein a lost communication caused by damage of a RFID tag of the plurality of RFID tags indicates a depth of wear associated with a radial position of the RFID tag.

15. The method of claim 14, wherein the initialization information comprises at least one selected from the group consisting of: a composition of the seal element; an initial count of the plurality of RFID tags embedded in the seal element; a depth distribution of the plurality of RFID tags; a unique serial number assigned to the seal element; a manufacturing date of the seal element; and a type of the array of the plurality of RFID tags.

16. The method of claim 14, wherein the plurality of RFID tags is disposed at a plurality of axial positions relative to the axial axis of the seal element, and the lost communication caused by damage of the RFID tag further indicates an axial location of the wear associated with an axial position of the RFID tag.

17. The method of claim 14, wherein querying the plurality of RFID tags is executed for each revolution of the seal element relative to the first communication device.

18. The method of claim 14, wherein the plurality of RFID tags is disposed at a plurality of circumferential positions in a circumferential direction about the axial axis of the seal element, and the lost communication caused by damage of the RFID tag further indicates a circumferential location of the wear associated with a circumferential position of the RFID tag.

19. The method of claim 18, further comprising:

using the control system to associate one or more non-responsive RFID tags with a type of wear pattern of the seal element; and displaying the type of wear pattern of the seal element along with an alarm level or confidence level associated with the type of wear pattern of the seal element.

* * * * *